United States Patent [19]

Kitchman

[11] Patent Number: 4,590,623

[45] Date of Patent: May 27, 1986

[54] ELECTROSTATIC DISSIPATIVE GARMENT

[75] Inventor: Fern E. Kitchman, Nashville, Tenn.

[73] Assignee: Blue Bell, Inc., Greensboro, N.C.

[21] Appl. No.: 650,785

[22] Filed: Sep. 17, 1984

[51] Int. Cl.[4] ..... A41D 3/02

[52] U.S. Cl. ..... 2/85; 57/901

[58] Field of Search ..... 2/85, 93, 114, 94–98; 57/901 E

[56] References Cited

U.S. PATENT DOCUMENTS 1,134,643 4/1915 Sinclair ..... 2/93

1,561,948 11/1925 Rohr ..... 2/93

3,851,456 12/1974 Harmada et al. ..... 57/901

4,422,483 12/1983 Zins ..... 57/901

*Primary Examiner*—Doris L. Troutman

*Attorney, Agent, or Firm*—Charles R. Rhodes; Judith E. Garmon

[57] ABSTRACT

A static dissipative garment configuration for persons employed in the manufacture and testing of sensitive electronic components. The garment is formed from a fabric which exhibits an electrical resistance of less than $10^8$ ohms per unit square and a decay time of no greater than 0.05 seconds. The garments also include tapered sleeves, steel snaps and are at least ¾ length and include side slits extending from the bottom hem upwardly.

3 Claims, 4 Drawing Figures

ELECTROSTATIC DISSIPATIVE GARMENT

BACKGROUND AND SUMMARY OF THE PRESENT INVENTION

Almost everyone has experienced static discharge or shock. In the wintertime, when one walks across the carpet and touches a doorknob, they feel such a static discharge or shock. Static is electricity, but, unlike conventional household electricity, which is electricity in current or flow, static is electricity at rest. Static occurs when two materials in contact (e.g. your shoe and the carpet) are separated, as in walking. On a typical cold day with low humidity, the static buildup in the human body by walking across a nylon carpet can be as much as 35,000 volts. The human body has a static threshold of pain at 10,000 volts and the body does not even feel static discharge at levels less than 3,000 volts.

Static buildup is a part of every day life. Clothes taken out of a dryer have static buildup, plastic trays drawn across a table have static buildup, and cellophane tape as it is removed from a dispenser has static buildup. The shock at a doorknob, and the other examples of static may be an irritation but there is no real damage.

However, should even a small static charge pass through sensitive electronic components, disastrous results may occur. As stated hereinabove, while the human body cannot even feel static at levels less than 3,000 volts, as little as 100 volts can damage or destroy sensitive electronic components. As sophistication and miniaturization have occurred in electronics, the sensitivity to electrostatics discharge has greatly increased. The discharge of static into an electronic component will hereinafter be referred to as "zap." Zap normally occurs when an electronic component which is sensitive to electrostatic discharge comes into contact with a material having a static buildup. However, zap can occur without direct contact. The static laden material, item or person generates an electrostatic field which can zap a component by induction.

In a normal electronic testing or assembly operation, induction is especially important when considering static buildup on apparel. Apparel made from wool, silk, and synthetic fibers are especially conducive to generating static buildup to levels as high as 1500 volts and higher in areas where heavy activity is occurring. Even cotton, in low humidity situations, can cause static buildup. The cost of damage and rework on electronic components and circuits due to zap has been estimated at 500 million dollars per year by some experts. Other experts believe an annual potential of 5 billion dollars can be saved by the elimination of staticrelated damage. If zap is discovered at the chip stage, it is relatively inexpensive to replace. If it is discovered at the board stage (assembled chips) the cost may be from $15 to $30. If zap is not discovered until it is already in a piece of machinery, the costs can run into thousands of dollars, or even worse can lead to product failure.

Static awareness and recognition of the scope of the potential damage is a large part of the problem. While an employee cannot feel a 1000 volt static discharge, or see it, hear it, smell it, or taste it, such a relatively undetectable static discharge can cause a very large number of electronic component failures.

Some attempts have been made to alleviate this problem, such as the use of topical treatment for garments. It is believed, however, that such topical treatments are not completely satisfactory for two reasons. First of all, the treatment is too easily lost by laundering or washing. Secondly, in order to be effective, the resistance of the fabric from which the garment is made must be less than $10^{10}$ ohms per unit square. It is not believed that topical treatments can effectively maintain a conductivity such that the resulting resistance of the fabric is so low. In addition to topical treatments, some firms have marketed garments which have as much as 1% steel fiber blended with polyester and cotton. Such fabric and garments were developed for use in hospital operating room apparel where static concern exists if certain anesthestics are used which can lead to explosion. While such fabrics may prove satisfactory for the operating room and environment, they are not conductive enough for the static sensitivities for today's electronic components.

A second problem which must be confronted by such fabrics is the problem of decay time. A standard measurement of decay time is the amount of time it takes for a static charge of 5000 volts to dissipate to a level of 10% of the applied voltage (500 volts) in an environment of 70° F. with a maximum relative humidity of 15%. To be an effective static dissipative fabric, it should exhibit a "decay time" of no more than 0.05 seconds under such a test.

In confronting this problem, applicants have researched the work activities in today's electronic industry and incorporated such findings into the garment design.

In addition to the fabric construction, which applicants have determined should be such as to exhibit a resistivity of no greater than $10^8$ ohms per unit square, it has also been determined by applicants that the design of the garment itself is also very important. Even if a worker is wearing a garment formed of a static dissipative fabric, the garment can still have static buildup if other design criteria are not met. Thus, if the subject is sitting in a conductive chair at a static free work environment, and leans forward to work on a circuit or component, should the garment be of insufficient length (e.g. a jacket), so that there is no contact of the garment with the conductive chair, the static buildup in the garment will have to find another path to ground, which will generally be through the sensitive electronic device. Thus, it has been determined that the garments according to the present invention are of sufficient length so that the garment always maintains contact with a conventional conductive chair upon which the worker is seated. Therefore, the garments according to the present invention are at least ¾ length, so that regardless of whether the worker is leaning forwardly in his chair, a portion of the garment remains tucked under the worker's seat in contact with the conductive seat of the chair. Further, the garment is characterized by having metallic snap closures which prevent the buildup of static, tapered sleeves (which are very important), a box pleat in the back that allows for stretching across a desk or worktop, and a three inch vertical slit on each side extending upwardly from the bottom edge for ease of movement in walking.

It is therefore an object of the present invention to provide an improved electrostatic dissipative garment for use in and around sensitive electronic components.

It is another object of the present invention to provide a garment of the type described which prevents damage to electronic components as a result of electrostatic discharge.

Other objects and a fuller understanding of the invention will be apparent upon reading the following detailed description of a preferred embodiment along with the accompanying drawings in which.

DETAILED DESCRIPTION OF A PREFERRED EMBODIMENT

Figure 2:
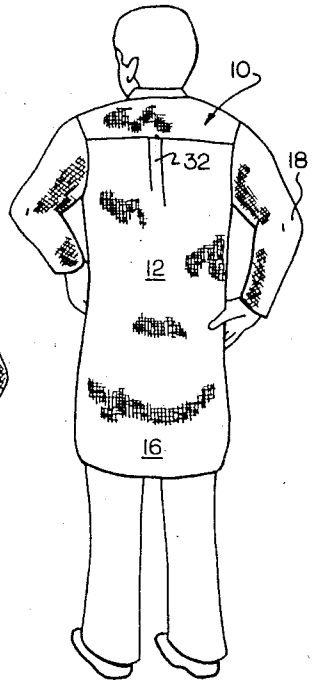
FIG. 2 is a perspective view similar to FIG. 1 except looking from the rear.
Figure 1:
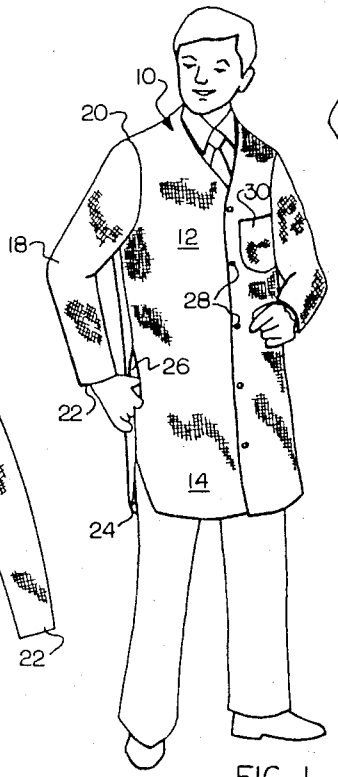
FIG. 1 is a perspective view, looking from the front and illustrating the garment being worn.
Figure 3:
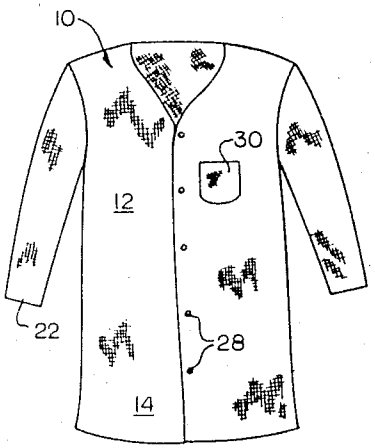
FIG. 3 is a front view of the garment according to the present invention.
Figure 4:
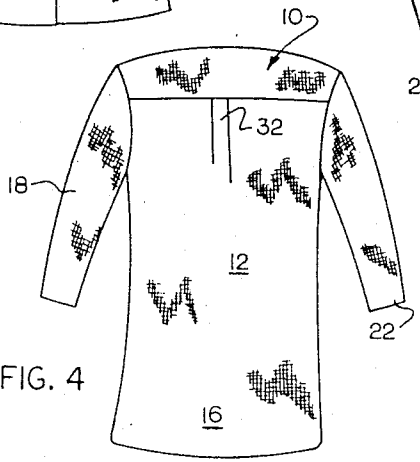
FIG. 4 is a rear view of the garment according to the present invention.

Turning now to the drawings, there is illustrated in FIG. 1 a garment 10 according to the present invention which includes a body portion 12 having lower extending tail portions 14 and 16 extending downwardly to a point about three to five inches above the knee.

The garment 10 is also provided with full length sleeves 18, which are conventional in nature with the exception that the sleeves taper inwardly from the shoulder 20 to the wrist 22. In a men's garment the diameter at the wrist portion 22 should be approximately ten inches; in a ladies garment the same diameter is on the order of eight inches.

A slit 24 of a length of about three inches extends upwardly from the lower hem on either side between the front tail portion 14 and the rear tail portion 16 to provide easier walking for the operator. Further, a side vent or opening 26 is formed on either side of body portion 12 about midway between the bottom edge and the arm portion to permit access by the operator beneath the garment to his regular clothing therebeneath.

Along the front of body portion 12 there is provided a row of closures 28. The closures 28 are formed of a steel, preferably stainless steel material, so as to conduct any electricity and not provide a point of buildup for static electricity. The body portion 12 is provided with a single breast pocket 30 and no lower packets, because many technicians brace circuit boards on their lap and can snag on pockets, if located in this area. The back of body portion 12 is provided with a box pleat 32 that is sufficiently generous to allow for stretching across a desk top when reaching for equipment.

As stated hereinabove, the body portion 12 is provided with tails 14,16 because if a worker is wearing a short coat, and sitting in a conductive chair, as in a static-free work environment, as the operator leans forward to work on a circuit, the garment can have static buildup. To drain the electron charge there must be a path to ground. Therefore, when the worker leans forward it is desired that the coat tails remain in contact with the conductive chair and not cause the coat to be in "isolation."

A preferred fabric is woven from a blend of fibers containing 50% polyester/48.1% cotton/1.9% steel. This fabric is classed as static dissipative, which means that the resistance of the fabric is in the order of $10^5$ to $10^{10}$ ohms per unit square. Preferably, the fabric exhibits a resistance of less than $10^8$ ohms per unit square. Further, the fabric exhibits a decay time of 0.05 seconds, which means that when a 5000 volt charge is placed on the fabric, it is dissipated to less than 500 ohms in no more than 0.05 seconds.

While a preferred embodiment of the invention has been shown and described hereinabove, it is apparent that various changes and modifications might be made without departing from the scope of the present invention as set forth in the claims below.

What is claimed is:

1. An electrostatic dissipative coat for wear by personnel employed in the manufacture and testing of sensitive electronic components comprising a body portion and two sleeves, said sleeves being tapered from a larger diameter at the shoulder to a smaller diameter at the wrist, wherein said wrist dimension for men's garments is substantially ten inches and for women's garments is substantially eight inches; said body portion having front and rear tails extending downwardly therefrom to a point substantially 3–5 inches above the knee, side slits between said front and rear tails at the lower portion thereof approximately three inches in length, whereby said coat is of a length sufficient to tuck beneath the seat of a person in a seated position so that contact is maintained between the coat and the normally conductive chair.

2. The coat according to claim 1 further provided with steel snaps for closing the front portion of the body member.

3. The coat according to claim 1 wherein the lower portion of said body portion and front tail is void of any pockets.

* * * * *